US009517396B2

(12) United States Patent
Ireland et al.

(10) Patent No.: US 9,517,396 B2
(45) Date of Patent: Dec. 13, 2016

(54) CURLING BROOM INCORPORATING A MOTOR

(71) Applicants: John Albert Ireland, Jasper (CA); Alexander John Ireland, Montreal (CA)

(72) Inventors: John Albert Ireland, Jasper (CA); Alexander John Ireland, Montreal (CA)

( * ) Notice: Subject to any disclaimer, the term of this patent is extended or adjusted under 35 U.S.C. 154(b) by 365 days.

(21) Appl. No.: 14/201,732

(22) Filed: Mar. 7, 2014

(65) Prior Publication Data

US 2015/0209638 A1 Jul. 30, 2015

Related U.S. Application Data

(60) Provisional application No. 61/931,553, filed on Jan. 24, 2014.

(51) Int. Cl.

| | |
|---|---|
| ***A63B 67/14*** | (2006.01) |
| ***A46B 13/02*** | (2006.01) |
| *A63B 71/06* | (2006.01) |

(52) U.S. Cl.

CPC ..... *A63B 67/148* (2013.01); *A46B 13/02* (2013.01); *A46B 2200/308* (2013.01); *A63B 71/0619* (2013.01)

(58) Field of Classification Search

CPC ... A63B 67/148; A63B 71/0619; A46B 13/02; A46B 2200/308

See application file for complete search history.

(56) References Cited

U.S. PATENT DOCUMENTS

| | | | | |
|---|---|---|---|---|
| 3,715,772 | A * | 2/1973 | Downing | A47L 11/12 15/22.2 |
| 4,349,933 | A | 9/1982 | Thompson | |
| 5,638,572 | A | 6/1997 | Canni Ferrari | |
| 5,722,112 | A * | 3/1998 | Scanni | A47L 5/24 15/344 |
| 5,956,792 | A * | 9/1999 | Gutelius | A46B 13/008 15/22.1 |
| 7,631,387 | B2 | 12/2009 | Sclafani et al. | |
| 8,443,478 | B2 | 5/2013 | West et al. | |
| 2004/0177458 | A1* | 9/2004 | Chan | A61C 17/3472 15/22.1 |

(Continued)

*Primary Examiner* — Dung Van Nguyen

(74) *Attorney, Agent, or Firm* — Murray IP Consulting Inc.; Sean Murray

(57) ABSTRACT

A motorized broom that may be used in the game of curling is provided. The broom comprises a moveable synthetic fabric brush head that can provide a sweeping motion consistent with the regulatory requirements governing the game of curling. The motorized curling broom can assist individuals who would otherwise not be able to effectively accomplish a sweeping motion with their own strength or stamina to participate recreationally and competitively in the game. The curling broom comprises: a motor and associated gear reduction and crank configuration for causing a sinusoidal back and forth sweeping action of the brush head. The broom further includes a user control mechanism for intuitive adjustment of the power supplied to the brush head by way of controlling the speed of the motor and the pressure applied to the sweeping surface. A dynamic balancing mechanism reduces unwanted vibration transmitted to the individual using the broom.

35 Claims, 10 Drawing Sheets

(56) References Cited

U.S. PATENT DOCUMENTS

| | | | | |
|---|---|---|---|---|
| 2005/0011028 | A1 | 1/2005 | Chow | |
| 2007/0074358 | A1* | 4/2007 | Tsai | A46B 5/0033 15/42 |
| 2010/0024145 | A1 | 2/2010 | Hoesli | |
| 2011/0167578 | A1 | 7/2011 | Jenkyn et al. | |
| 2016/0150928 | A1* | 6/2016 | Kim | A47L 9/0633 15/414 |

* cited by examiner

CURLING BROOM INCORPORATING A MOTOR

CROSS-REFERENCE TO RELATED APPLICATION

The present application claims the benefit under 35 USC 119(e) of U.S. Provisional Patent Application 61/931,553 filed on Jan. 24, 2014 and hereby incorporated by reference herein.

FIELD OF THE INVENTION

The invention relates generally to brooms and, more particularly, to curling brooms incorporating a motor.

BACKGROUND

Brooms used in the game of curling can be used by a curler to significantly modify the slide distance and trajectory of a delivered curling rock. It is known that when any object moves by itself or is encouraged to move across the surface of an ice sheet, that it does so by forming a thin layer of water between the moving object and the solid surface of the ice. In the case of a curling rock, this layer of water, which forms between the running ring on the underside of the granite body of the rock and the top surfaces of the pebbles or tiny bumps applied to the surface of a curling ice sheet during the ice making process, lubricates the sliding motion of the rock. The formation of this water layer requires a transfer of mechanical energy from the momentum of the moving rock to the surface of the ice and will therefore gradually reduce its momentum, which will eventually cause the rock to stop. The turn or slow spin which the curler applies to the rock upon delivery results in a side to side imbalance in the rate at which the momentum of the rock is lost to this energy transfer, resulting in a net sideways force on the travelling rock and the characteristic curl in the trajectory of a delivered curling rock. The action of sweeping the pebbled surface of the ice in front of the path of the rock with a curling broom pre-warms the ice surface, reducing the energy required to be transferred from the rock to the ice to form the water layer. This has been shown to increase the travel distance of the rock as well as modify its tendency to curl, thus allowing members of the curling teams to effectively influence the trajectory and ultimate final position of the rock on the ice. The sweeping action also helps to remove unwanted particulate material from the ice surface in the path of the rock which could negatively affect the trajectory of the rock.

The game of curling is played worldwide by competitive and recreational curlers ranging in age and skill levels from small children and beginners to the elderly and highly skilled competitive athletes. The action of sweeping the rocks requires a degree of physical fitness and stamina which can preclude some players from continuing to play the game once they have experienced some illnesses, injuries or advanced age even if they have subsequently regained a degree of health and fitness. In many cases, players who can no longer effectively sweep the rock will quit the game. When a player who has enjoyed the game for many years quits, they no longer benefit from the physical activity, feeling of accomplishment and competition, or the camaraderie and social benefits of curling club membership.

The traditional configuration of curling brooms has changed significantly throughout the history of the game. During the 1950s and 1960s the use of the traditional corn broom was gradually replaced by brushes of fibre or horse hair and then by foam covered with various fabrics. Brush heads fixed solidly to broom handles have subsequently been replaced by flexible attachments which allow the brush surface to contact the ice surface more evenly and handles made of solid wood have been replaced by light weight hollow tubes of fibre reinforced composites.

The sport of curling has consistently demonstrated a willingness to embrace changes and innovations which enhance the enjoyment of the game and encourage participation with resulting benefits of physical activity and social involvement. Within the last decade, the use of innovative equipment has contributed to increased enjoyment of the game of curling by individuals who cannot bend over due to physical limitations in order to push themselves out of the hack when delivering a rock down the ice. The push-stick allows a curler to deliver and apply a turn to the rock while maintaining an erect body position. This has allowed a curler who would have otherwise quit the game because of some physical limitation to continue to participate.

Against this background, there is a need for solutions that will mitigate at least one of the above problems, particularly an improved curling broom. It is an object of this invention to allow a curler to sweep effectively while mitigating the level of uncomfortable or dangerous physical stress on their bodies.

SUMMARY OF THE INVENTION

The present invention is directed to an improved curling broom and brush head. In an embodiment of the present invention, the back and forth manual sweeping action traditionally performed by a curler is replaced by a motor incorporated within the curling broom that causes a back and forth reciprocating motion of a brush head on the ice while minimizing the forces required to be applied by the curler. With the motorized curling broom of the present invention, individuals who can no longer sweep effectively can continue to participate as an effective team member in the game.

According to a first broad aspect, the present invention is a curling broom comprising: an elongated handle; a brush head coupled to the elongated handle; and a motor coupled to the brush head and operable to cause motion of the brush head. The motor can be operable to cause reciprocating lateral motion of the brush head. Further, the motor can be incorporated within a module, the module further comprising a crank coupled to the motor that is operable to rotate when actuated by the motor. The crank when rotated can be adapted to cause a sinusoidal reciprocating movement of the brush head.

In particular embodiments of the present invention, the brush head may comprise a lateral slot with two parallel lateral surfaces adapted for the crank to be inserted. The crank when rotated can be adapted to push against the lateral surfaces of the lateral slot to cause the sinusoidal reciprocating movement of the brush head. The crank can also comprise a counterbalance, thereby reducing vibration caused by the rotating of the crank. The module can further comprise a gear reduction element connected between the motor and the crank and adapted to limit a speed of rotation of the motor to a predetermined level. The gear reduction element can limit the maximum reciprocating motion of the brush head to approximately ten hertz or another level as may be desired.

In various embodiments of the present invention, the module may further comprise a slide plate, the slide plate comprising at least one first slide element. The brush head may comprise at least one second slide element that is adapted to slide in contact with the first slide element of the slide plate to allow lateral movement of the brush head relative to the slide plate. The crank when rotated may be adapted to cause the second slide element of the brush head to slide through the first slide element of the slide plate, thereby causing lateral movement of the brush head. In some cases where the brush head comprises a lateral slot with two parallel lateral surfaces adapted for the crank to be inserted, the crank when rotated is adapted to push against the lateral surfaces of the lateral slot to cause the second slide element of the brush head to slide through the first slide element of the slide plate, thereby causing lateral movement of the brush head. The crank can also comprise a counterbalance, thereby reducing vibration caused by the rotating of the crank.

In some embodiments of the present invention, the curling broom may comprise a control apparatus operable to dynamically control a speed of the motor. The control apparatus may comprise a user control mechanism operable to modify the speed of the motor dependent on a physical position of an element of the mechanism. The user control mechanism can be integrated within the elongated handle and comprise a sliding handle operable to slide along a shaft of the elongated handle. The speed of the motor may be dependent upon the physical position of the sliding handle. In a first position of the sliding handle, the speed of the motor can be at a minimum level and, at a second position of the sliding handle, the speed of the motor can be at a maximum level. The user control mechanism may further comprise a spring adapted to be compressed by a user moving the sliding handle from the first position towards the second position and adapted to decompress and move the sliding handle towards the first position if no force is applied to the sliding handle. The control apparatus may further comprise a control element operable to control the speed of the motor based on a resistance setting of a potentiometer. The user control mechanism may comprise the potentiometer and the physical position of the element of the user control mechanism may determine the resistance setting of the potentiometer. The control element may comprise a power MOSFET coupled between a power source and the motor and the control element can be operable to activate and deactivate the power MOSFET based upon the resistance setting of the potentiometer, thereby controlling the speed of the motor. In some alternative embodiments, the control apparatus may comprise a user control interface operable to modify the power to the motor dependent on a setting of the user control interface. This could be triggered by various electronic and/or mechanical switches, buttons, triggers or other elements. In some implementations, the motor is incorporated within a module and the module is connected to the elongated handle and further connected to the brush head, whereby the brush head is coupled to the elongated handle via the module. The module may be connected to the elongated handle via a flexible joint such as one of a gimbal and a yoke-and-trunnion. The brush head may be removable from the module.

The motor can be an electric motor and the curling broom can further comprise a power source to power the motor. The power source may be integrated within the elongated handle. The elongated handle may comprise first and second ends, the first end being coupled to the brush head while the power source comprises a battery pack integrated into the second end of the elongated handle. The battery pack may be removable from the curling broom for charging and the battery pack may be adapted with a charging terminal within the elongated handle.

According to a second broad aspect, the present invention is an apparatus comprising: a brush head; and a motor coupled to the brush head and operable to cause lateral reciprocating motion of the brush head. The apparatus may further comprise an elongated handle coupled to the brush head and brush head may comprise an ice interface element adapted for contact with ice on a curling rink.

According to a third broad aspect, the present invention is a brush head adapted to be connected to a curling broom handle. The brush head comprises an ice interface element adapted for contact with ice on a curling rink; and a brush head frame connected to the ice interface element. The brush head frame is adapted to be coupled to a crank and is adapted to respond to a rotation of the crank with lateral reciprocating motion. In some embodiments, the brush head frame is adapted to be connected to a slide plate coupled to the curling broom handle, the slide plate comprising at least one first slide element. The brush head frame may comprise at least one second slide element that is adapted to slide in contact with the first slide element of the slide plate to allow lateral movement of the brush head relative to the slide plate. Further, the brush head frame may comprise a lateral slot with two parallel lateral surfaces adapted for a crank operable to rotate to be inserted. When the crank is rotated, the crank is adapted to push against the lateral surfaces of the lateral slot to cause a sinusoidal reciprocating movement of the brush head. In some embodiments, the brush head further comprises a crank connected to the brush head frame and adapted to be connected to a motor coupled to the curling broom handle. The crank is operable to rotate when actuated by the motor and, when rotated, is adapted to cause a sinusoidal reciprocating movement of the brush head.

These and other aspects of the invention will become apparent to those of ordinary skill in the art upon review of the following description of certain embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which.

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

The present invention is directed to a motorized broom that may be used in the game of curling. The curling broom, according to an embodiment of the present invention, comprises a moveable synthetic fabric brush head that can provide a sweeping motion consistent with the regulatory requirements of the bodies governing the game of curling in Canada and worldwide. The present invention can allow those individuals who would otherwise not be able to effectively accomplish a sweeping motion with their own strength or stamina to participate recreationally and competitively in the game.

The curling broom, according to various embodiments of the present invention, comprises: a motor and associated gear reduction and crank configuration for causing a sinusoidal back and forth sweeping action of the brush head; a power source such as an electrical battery that may be replaceable and/or rechargeable for providing power to the motor; a user control mechanism for intuitive adjustment of the power supplied to the brush head by way of controlling the speed of the motor and the pressure applied to the sweeping surface; a dynamic balancing mechanism for reducing unwanted vibration transmitted to the individual using the broom; and an ergonomic handle, brush head and intuitive speed control for minimizing physical stress and stamina requirements of the individual using the broom while allowing for ease of use, transportation and storage. The power to the motor may be controlled through an electronic Direct-Current (DC) or Alternating Current (AC) speed controller (or more generally a control element). The motor can then turn the input of a gear reduction with an output connected to a crank which results in a sinusoidal movement of a slide resulting in a smoothly reciprocating brush head to which is incorporated a brush surface made of synthetic fabric covering a layer of soft foam.

Figure 1A:
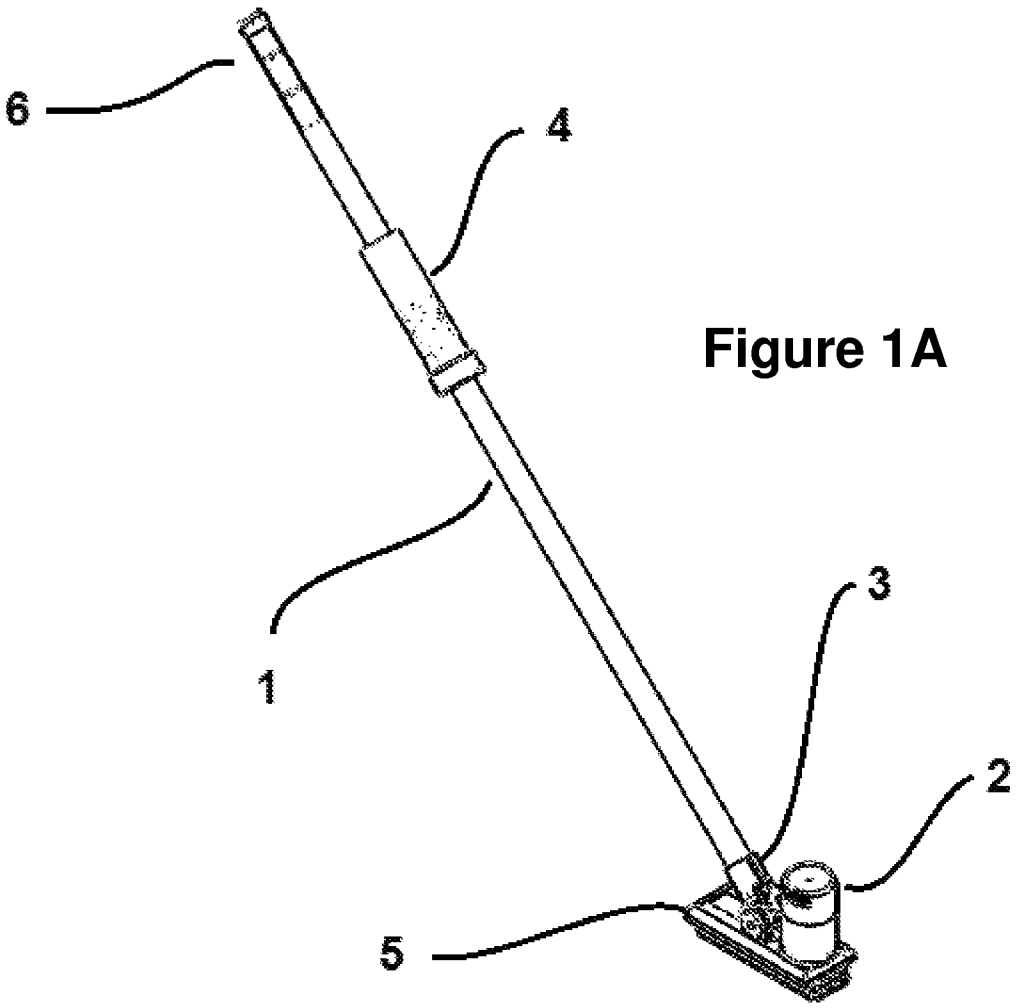
FIGS. 1A and 1B are an overview and a zoomed-in view respectively of a curling broom according to an embodiment of the present invention.
Figure 1B:
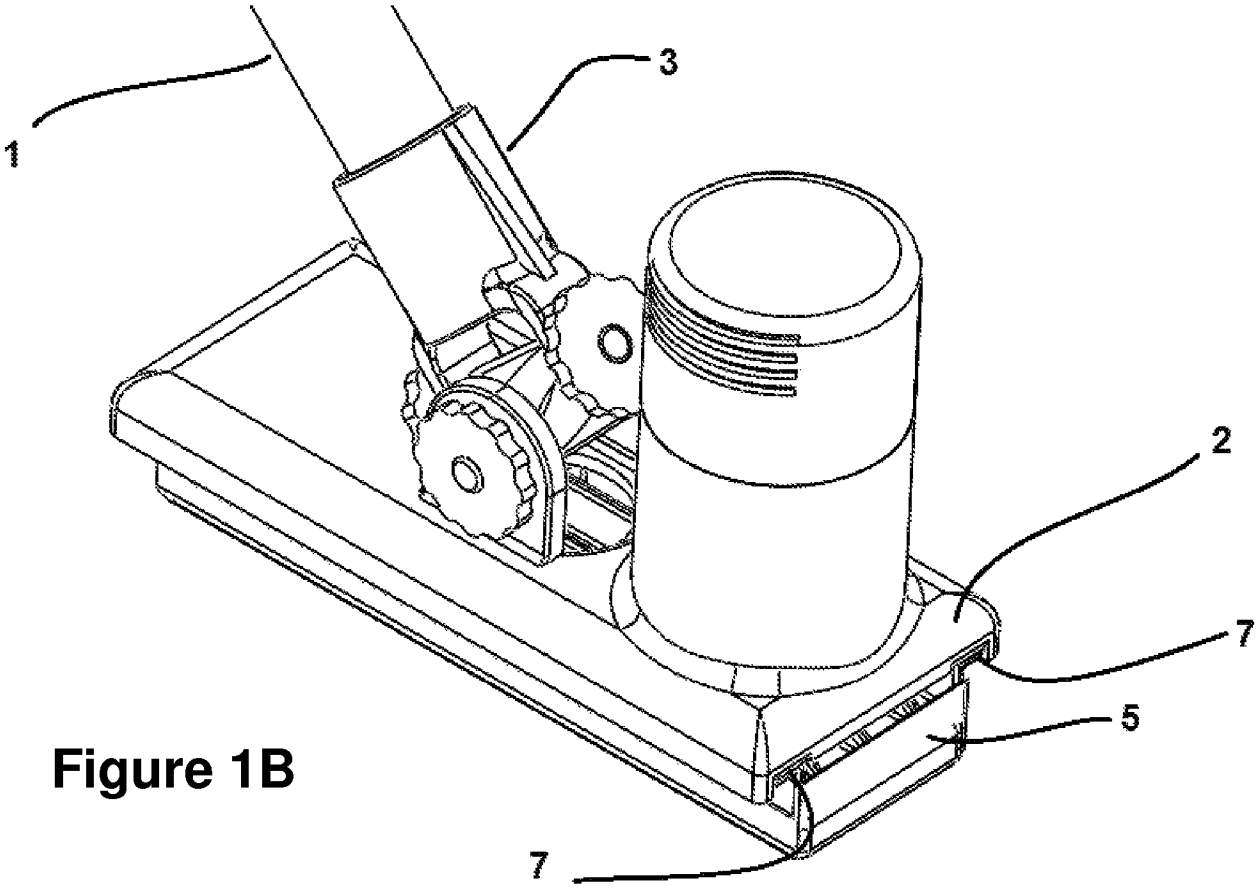

FIGS. 1A and 1B are an overview and a zoomed-in view respectively of a curling broom according to an embodiment of the present invention. As shown, the curling broom comprises an elongated handle 1 coupled to a motor module 2 with a flexible joint 3. The curling broom further comprises a brush head 5 that is coupled to the motor module 2 and is operable to move laterally back and forth along slide tracks 7 of the motor module 2. Also shown integrated within the handle 1 are a power source 6 and a user control mechanism 4.

In one embodiment, the handle 1 is comprised of a hollow shaft of tubing. The handle could be made of fibre reinforced plastic composite tubing or other suitable material. The flexible joint 3 may be a Gimbal or yoke-and-trunnion flexible joint, though in some alternative embodiments other flexible mechanisms could be used or the connection between the handle 1 and the motor module 2 may be fixed. The power source 6 may be integrated into the end of the handle 1, though in alternative embodiments it may be integrated into another location within the handle 1 or the motor module 2. The power source 6 may comprise a battery pack that may be removable or may be rechargeable while remaining integrated within the handle 1. The power from the power source 6 is used to energize the motor module 2 and may be controlled by the curler with the use of the user control mechanism 4. The user control mechanism 4, in some embodiments, comprises a sliding hand grip and fixed retaining components. In this case, the user can control the power to the motor module 2 by applying pressure to move the hand grip relative to the fixed retaining components along the handle 1. The use of a hand grip can provide an intuitive control for a user, though it should be understood that other control mechanisms and electric controls could be used. The operation of the user control mechanism 4 in one embodiment will be described in more detail with reference to FIGS. 7A and 7B.

Figure 2:
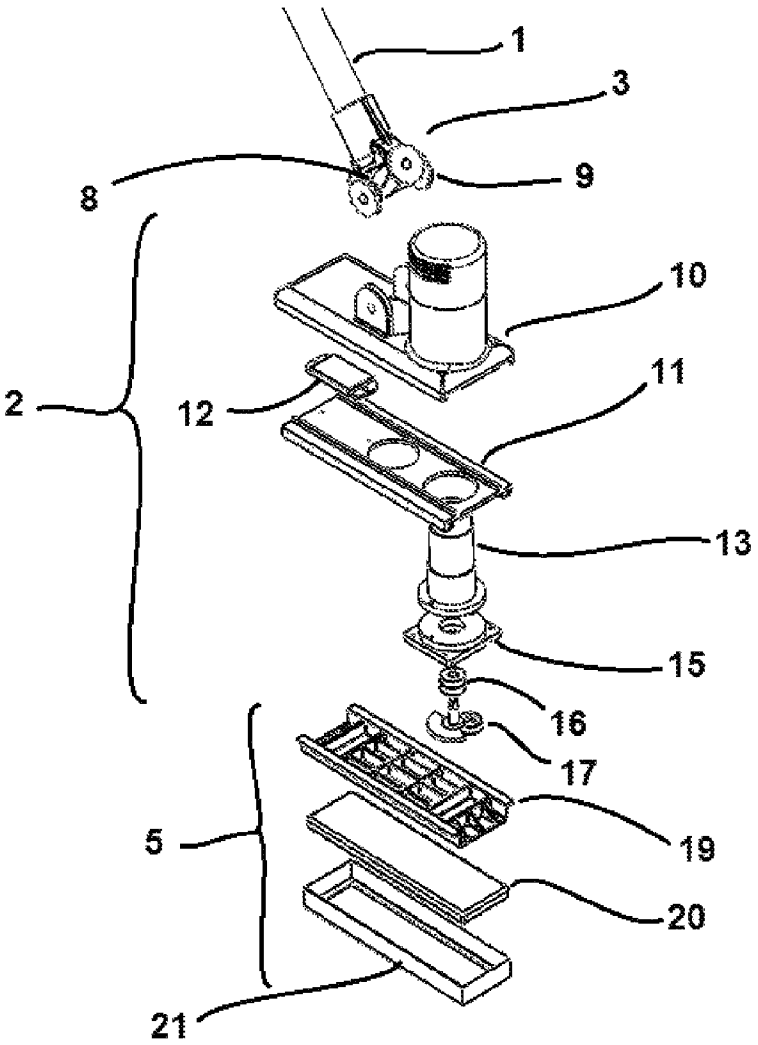
FIG. 2 is an exploded view of components within the curling broom of FIGS. 1A and 1B according to an embodiment of the present invention.

FIG. 2 is an exploded view of the flexible joint 3, the motor module 2 and the brush head 5 according to an embodiment of the present invention. This figure exemplifies a method of assembly of these modules according to one embodiment of the present invention. In this embodiment, the flexible joint 3 comprises a moulded gimbal flexible joint with a moulded cross component with threaded metal trunnion pins 8 and threaded hand nuts 9 that provide compression and friction to the flexible joint. The flexible joint 3 moveably joins the assembly of the handle 1 with the motor module 3. This design for the flexible joint 3 allows the brush head 5 in operation when it is in reciprocating motion to remain uniformly in contact with the ice surface independent of the position in which the shaft of the handle 1 is held by the user. Adjustable residual friction can be provided in this flexible joint 3 to aid in positioning of the brush head 5 during use by loosening or tightening the threaded trunnion pins 8 to reduce or increase friction in the joint. It should be understood that other flexible or fixed joints could be used to connect the handle 1 to the motor module 2 in alternative embodiments.

Within FIG. 2, the motor module 2 comprises a cover plate 10, a main slide plate 11, a control element 12, an electric motor 13, a reducing gear box 14, a bearing mount 15, a supporting bearing 16, a crank bearing 17 and a counterbalanced crank 18. The cover plate 10 may comprise moulded plastic, though other materials may be used including, but not limited to, metals and other formed materials. The cover plate 10 may comprise the mounting positions for the flexible joint 3 to connect the handle 1 to the motor module 2. The cover plate 10 may also have safety and/or aesthetic functions such as covering the electric motor 13 and other mechanical or electrical components such that these components cannot be easily touched and/or viewed. The main slide plate 11 may be removeably attached to the cover plate 10 by threaded fasteners or integral snap features, though other means for fastening the main slide plate 11 could be used. The main slide plate 11 can provide a mounting location for the control element 12 and a surface upon which the brush head 5 can slide using the slide tracks 7 as will be described with reference to FIGS. 3, 4A and 4B.

The brush head 5 comprises a brush head frame 19, a foam cushioning pad 20 and a cover material 21. The brush head frame 19 may comprise moulded polymer material while the cover material may comprise synthetic fabric. It should be understood that other materials could be used within the components of the brush head 5. The foam cushioning pad 20 and the cover material 21 can be attached by adhesive to the underside of the brush head frame 19, or be coupled through other means including, but not limited to screws and staples. The combination of the foam cushioning pad 20 covered by the cover material 21 attached to the underside of the brush head frame 19 can provide a compliant brush surface which is suitable to slide across the pebbled surface of the curling ice while in reciprocating motion to provide an effective back and forth sweeping action. The foam cushioning pad 20 and the cover material 21 together can comprise one example of an ice interface element adapted for contact with ice on a curling rink. It should be understood that other materials and combination of elements may be used that would be acceptable for sweeping on a curling rink. The curling associations and curling rink management typically set criteria for such ice interface elements.

To achieve this motion, when powered, the electric motor 13 can drive the counterbalanced crank 18 through the reducing gear box 14 and supporting bearings 16 (mounted within the bearing mount 15) to provide the reciprocating motion to the brush head 5 by virtue of the crank bearing 17 travelling within a lateral slot 22 of the brush head frame 19 as will be described with reference to FIGS. 4A and 4B. The reciprocating motion of the brush head 5 can be maintained while pressure is applied to the broom by the use of low friction sliding rails 24 within the brush head frame 19 which impinge upon the surfaces of the slide tracks 7 of the main slide plate 11, providing linear guidance to the reciprocating brush head 5. The lateral slot 22 provided in the brush head frame 19 provides two parallel lateral surfaces which allow the crank 18 and its throw bearing 17 to translate the rotary motion of the reducing gear box 14 output into a sinusoidal reciprocating motion of the brush head 5. The reducing gear box 14 can be used to limit the speed of the motor 13 to a specified revolutions per minute which, in turn, limits the frequency of motion of the brush head 5. In one embodiment, the limit could be approximately 600 rpm or 10 Hz, though other limitations may be acceptable based on user tolerance and the applications. A counterbalance is affixed to the rotating output shaft and crank which dynamically balances the crank to minimize vibration due to the rotating motion of the crank 18.

As indicated, the main slide plate 11 may be removably attached to the cover plate 10 using elements such as threaded fasteners or integral snap features. In some embodiments of the present invention, once the main slide plate 11 is detached, the counterbalanced crank 18 and the crank bearing 17 may be lifted free of the lateral slot 22 allowing the brush head frame 19 with its attached foam pad 20 and cover material 21 to be slid free of the slide tracks 7 of the main slide plate 11 for ease of replacement once it becomes worn or contaminated. In one embodiment, to replace the brush head 5, a person can lift the cover plate 10 which raises the crank bearing 17 out of the lateral slot 22 within the brush head frame 19, allowing the brush head 5 to slide freely out of the slide tracks 7 of the main slide plate 11. A new brush head 5 may then be re-installed into the slide tracks 7 of the main slide plate 11 and the cover plate 10 replaced. In some embodiments, the brush head 5 that is to be replaced may also include other elements such as the crank bearing 17 and/or the counterbalanced crank 18. Further, the crank bearing 17 and/or the counterbalanced crank 18 may be separately replaceable from the brush head 5. Each replaceable item may be commercialized separately as different variations (materials, strengths, shapes, etc.) of these elements may be desired for various purposes.

Figure 3:
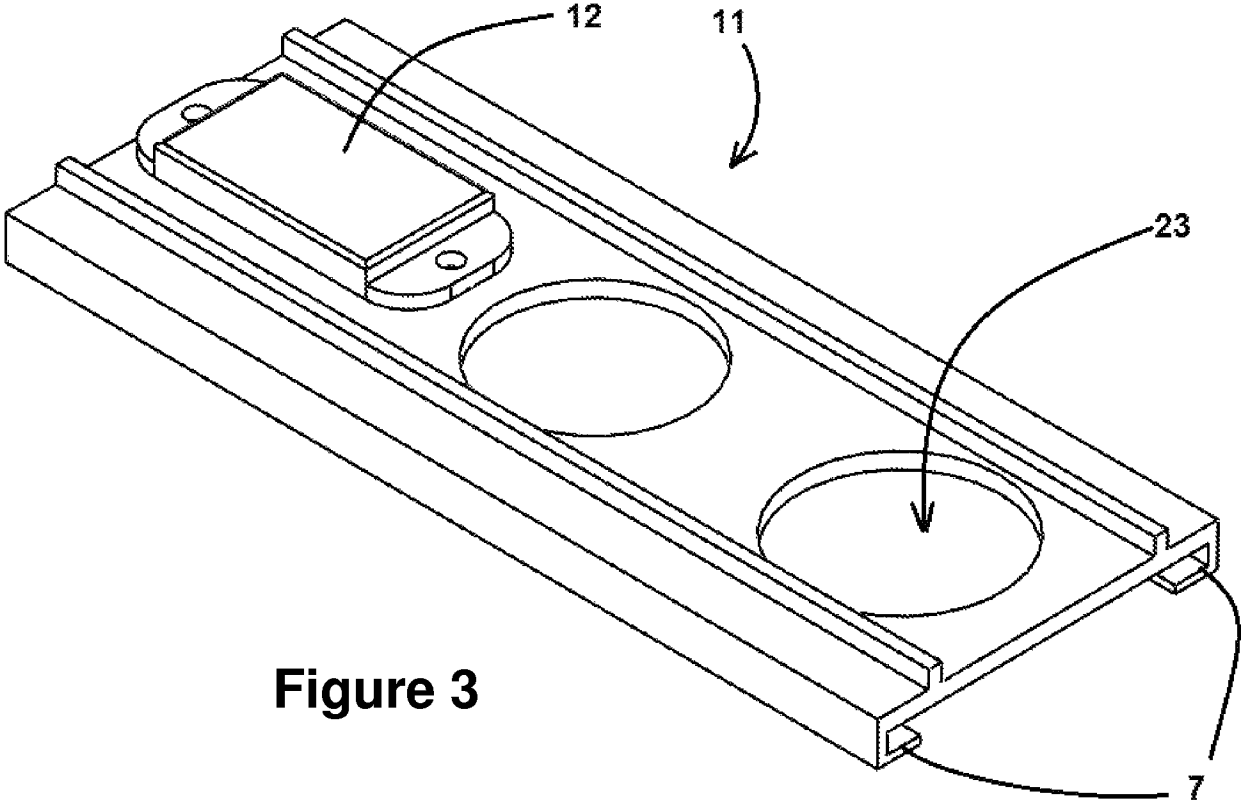
FIG. 3 is a zoomed-in view of a main slide plate of the curling broom of FIGS. 1A and 1B incorporating a control module according to an embodiment of the present invention.

FIG. 3 is a zoomed-in view of the main slide plate 11 incorporating the control element 12 according to an embodiment of the present invention. The main slide plate 11 may be fabricated from many different materials including, but not limited to, aluminum or other metals. For instance, the main slide plate 11 may comprise an aluminum extrusion or, in an alternative embodiment, comprise sheet metal that has been stamped and formed. The electronic control circuit 12 may be affixed to the main slide plate 11 in such a manner as to take advantage of the heat dissipation properties of the metal plate when in operation. The slide tracks 7 may run the length of both sides of the main slide plate 11 and may provide a track in which the slide rails 24 (shown in FIGS. 4A and 4B) of the brush head frame 19 are allowed to slide. A clearance hole 23 allows the counterbalanced crank 18 and crank bearing 17 to engage within the lateral slot 22 of the brush head frame 19. A second clearance hole is also shown that may be used to provide clearance for the flexible joint 3 and also reduces the weight of the curling broom by removing unnecessary material.

Figure 4A:
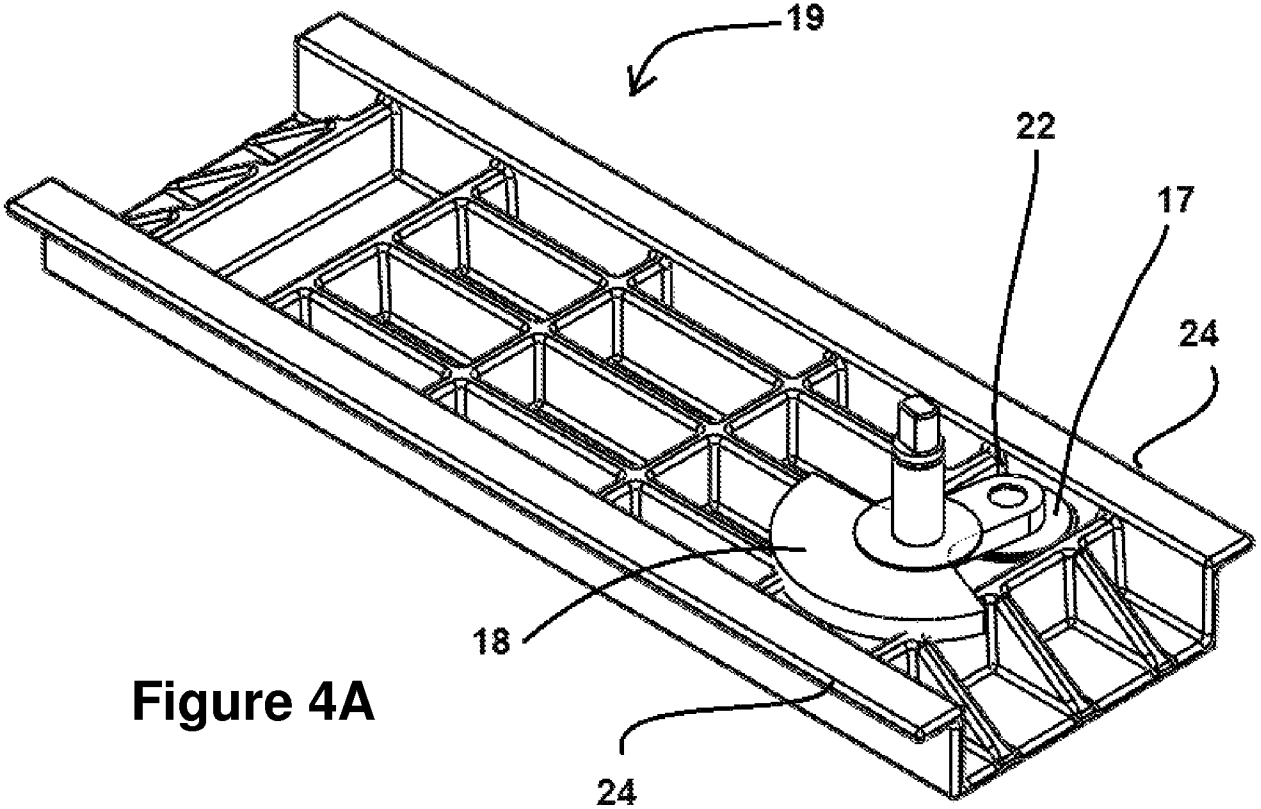
FIGS. 4A and 4B are zoomed-in views of a brush element frame of a brush head and the brush head respectively for the curling broom of FIGS. 1A and 1B according an embodiment of the present invention.
Figure 4B:
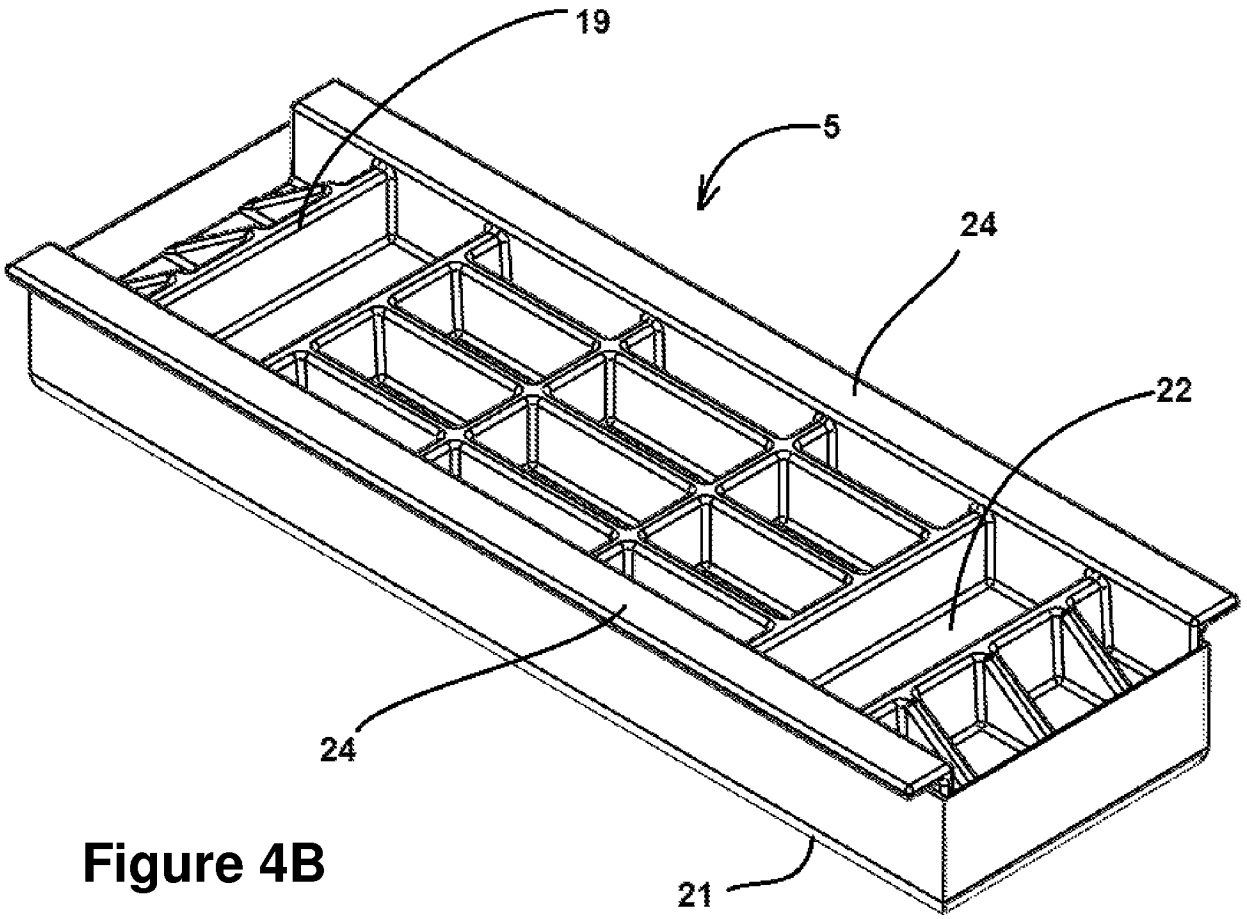

FIG. 4A is zoomed-in view of the broom element 19 according an embodiment of the present invention. As shown in FIG. 4A, the broom element 19, which may comprise a moulded polymer material, comprises two slide rails 24 along the length of both sides of the element. These slide rails 24 are designed to position within the slide tracks 7 of the main slide plate 11 and allow the brush head 5 to move back and forth in operation. The brush head frame 19 further comprises the lateral slot 22 which allows for mechanical engagement with the counterbalanced crank 18 and crank bearing 17 (illustrated for clarity in FIG. 4A). FIG. 4B illustrates a zoomed-in view of the complete brush head 5 according an embodiment of the present invention. As shown, the brush head frame 19 is coupled to the cover material 21 and provides for a replaceable element to change the foam pad 20, the cover material 21 if either were not ideal for the conditions, worn out or damaged in any way.

Figure 5:
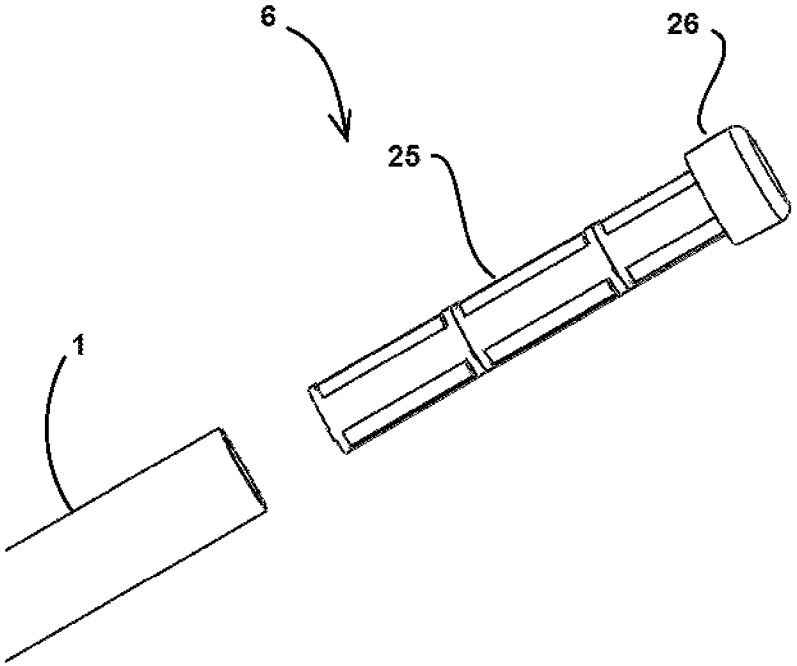
FIG. 5 is an exploded view of a power source incorporated within a handle of the curling broom of FIGS. 1A and 1B according to an embodiment of the present invention.

FIG. 5 is an exploded view of the power source 6 incorporated within the diameter of the handle 1 according to an embodiment of the present invention. In this case, the power source 6 comprises a removable and interchangeable battery pack 25 which may be rechargeable or non-rechargeable as needed and can be inserted into the hollow end of the handle 1 most distal from the brush head 5 attachment. In the case of a rechargeable battery pack, a standard charging connector can be provided integral to the end cap 26 of the battery pack. The battery pack 25 may be recharged while still attached to the broom by inserting the power plug of a charger into a mating jack or after being detached and re-attached to a charger external to the broom. Interchangeability of the battery pack 25 with a freshly charged one or a non-rechargeable battery will allow for continuing use of the broom without needing to stop its use for recharging. The battery pack 25 can be connected by a standard electrical connector 27 to a wiring harness 28 that can run through the handle 1 of the broom through the control element 12 to the electric motor 13. In other possible embodiments, the battery pack 25 may be mounted external to the broom handle 1 and in alternate locations such as proximal to the motor module 2 and/or the brush head 5.

Figure 6:
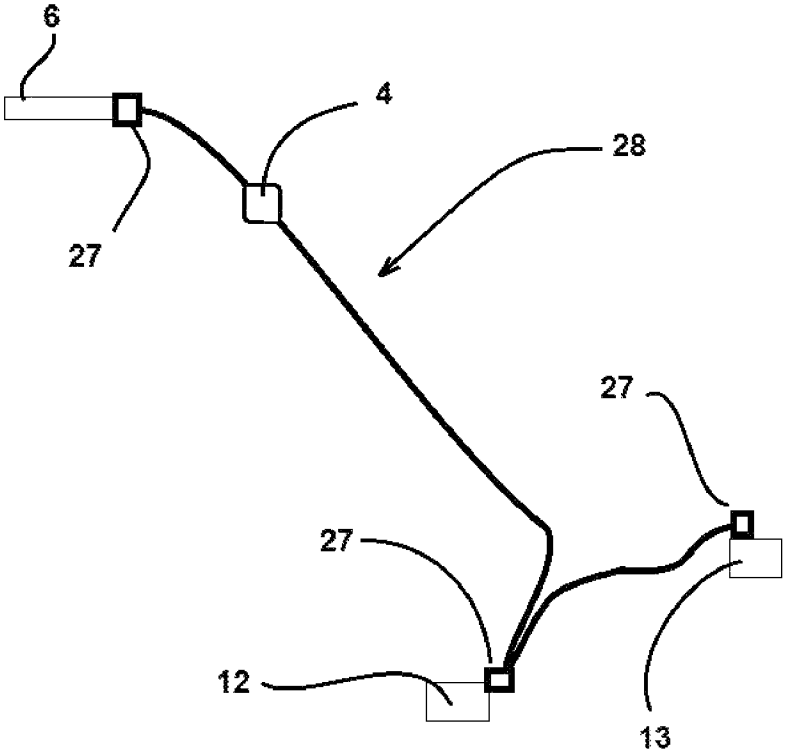
FIG. 6 is a wiring diagram for the curling broom of FIGS. 1A and 1B according to an embodiment of the present invention.

FIG. 6 is a wiring diagram for the curling broom of FIGS. 1A and 1B according to one embodiment of the present invention. As shown, an electrical wiring harness 28 connects the main electrical components through standard electrical connectors 27 to provide transmission of power from the power source 6 through the control element 12 to the electric motor 13. The control element 12 can then control the power to the motor 13. In one implementation, the control element 12 comprises a power MOSFET coupled between the power source 6 and the motor 13. The control element 12 can control activating and deactivating of the power MOSFET to limit the power to the motor 13 depending on a signal generated in response to a setting within the user control mechanism 4. It should be understood there are many alternative wiring diagrams possible to provide power to the electric motor 13 and, in some alternative embodiments, the electric motor may not be controlled by control elements such as the user control mechanism 4 and the control element 12. The electric motor 13 in some embodiments may be coupled directly to the power source 6. Also, in some implementations, the motor 13 may be an AC motor and may be controlled by the frequency of the AC input.

Figure 7A:
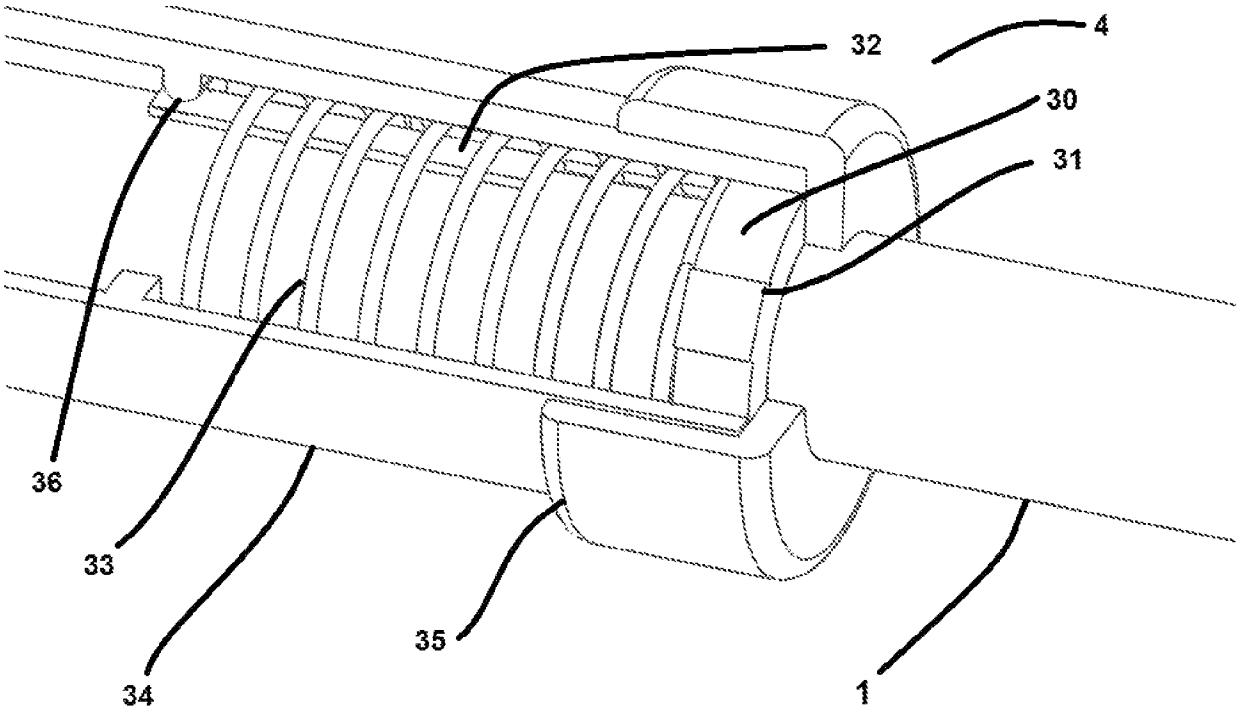
FIGS. 7A and 7B are cutaway views of a user control mechanism incorporated within a handle of the curling broom of FIGS. 1A and 1B according to an embodiment of the present invention, the mechanism being in first and second positions respectively.
Figure 7B:
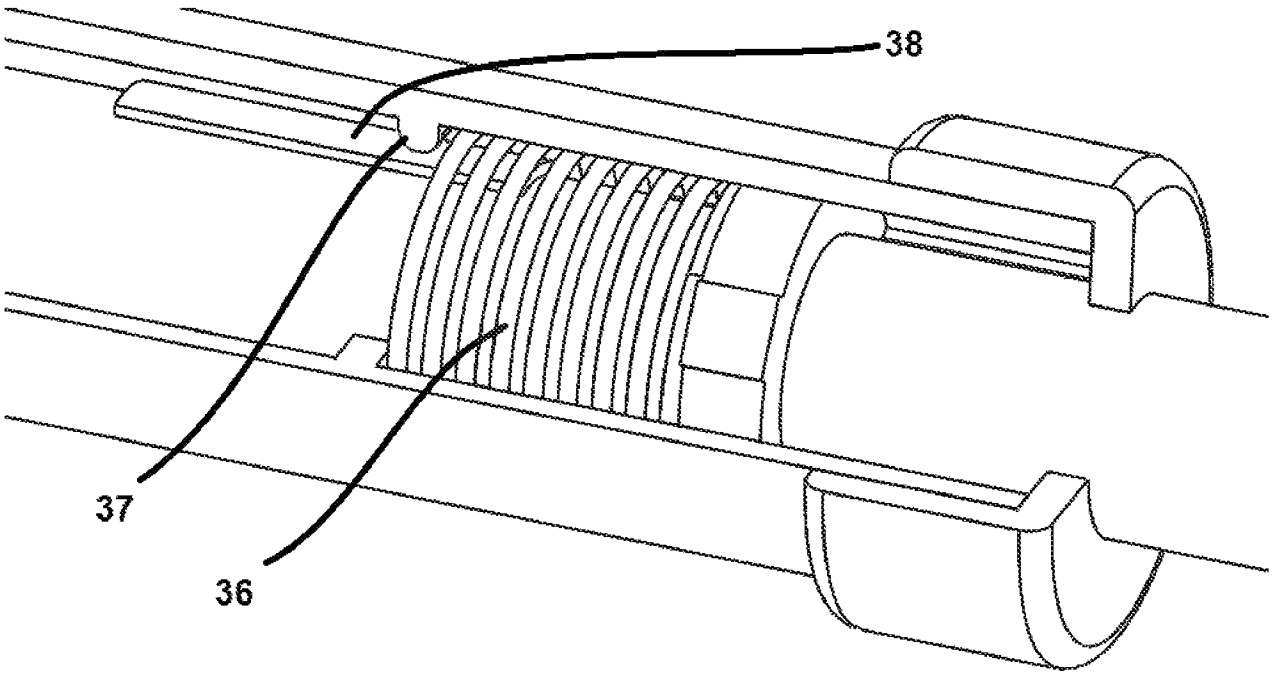

FIGS. 7A and 7B are cutaway views of the user control mechanism 4 incorporated within the handle 1 of the curling broom of FIGS. 1A and 1B according to an embodiment of the present invention. The mechanism 4 is in a first position that is a relaxed or zero power position within FIG. 7A and the mechanism 4 is in a compressed or high power position within FIG. 7B. The user control mechanism 4 attaches moveably to the broom handle 1 and can allow the user to increase the speed of the electric motor 13 and the power delivered to the reciprocating brush head 5 simultaneously with increased downward force on the brush head 5 against the ice resulting in increased sweeping effectiveness. In the embodiment of FIGS. 7A and 7B, the user control mechanism 4 comprises a collar 30 rigidly affixed to the broom handle shaft with guide protrusions 31 to which is mounted a linear electrical potentiometer 32 and against which a spring 33 rests. A generally cylindrical moveable sliding handle 34 with internal guide slots is positioned so as to compress the spring 33 when the user applies a force which pushes the sliding handle 34 downward toward the ice surface and is constrained from rotating by the guide protrusions of the collar 34. A stop ring 35 which is affixed to the sliding handle 34 constrains and limits the sliding motion of the sliding handle 34 to a suitable range of movement. Integral to the sliding handle 34 is a small pressure button 36 which is positioned so that it moves across the pressure sensitive length of the linear electrical potentiometer 32, which in turn adjusts the resistance of the potentiometer 32. The potentiometer 32 can be connected within an electrical circuit locally or within the control element 12 which can be used to generate a signal, such as a pulse width modulation signal, in response to the setting of the resistance within the potentiometer 32. In some embodiments, the control element 12 comprises a power MOSFET which can be controlled with the signal generated using the resistance setting of the potentiometer 32. In this case, the power MOSFET can be controlled to active or deactive for particular lengths of time and pass a set amount of power to the motor 13, thus controlling the speed of the motor 13 and, in turn, the frequency of motion of the brush head 5. Alternatively, if the motor 13 is an AC motor, the control element 12 could control the frequency of the input to the motor 13 in order to control the speed of the motor 13.

FIG. 7A exemplifies the sliding handle 34 of the user control mechanism 4 in its uncompressed or zero motor speed position in which the pressure button 37 impinges upon the linear electrical potentiometer 32 at its leftmost point of travel as shown. FIG. 7B exemplifies the sliding handle 34 of the user control mechanism 4 in its fully compressed position or high speed position in which the pressure button 37 impinges upon the linear electrical potentiometer at its rightmost point of travel as shown. In operation, the user control mechanism 4 allows a user to apply downward pressure to the broom while increasing the electrical power delivered to the electric motor 13 and therefore increasing the sinusoidal reciprocating sweeping frequency of the brush head 5 and its synthetic fabric surface simultaneously.

The use of the sliding handle 34 as the user control mechanism 4 provides an intuitive control for the user, in which the user can apply a force to the sliding handle 34 that is proportional to the speed that the user would like the motor 13 to operate and therefore the frequency the brush head 5 to move. It should be understood that other implementations could be used to allow for dynamic control of the speed of the motor. In some alternative embodiments, the user may interface with buttons, a trigger of another electrical and/or mechanical element that provides an indication of a desired speed of motion of the brush head 5.

The power source 6 may be of a DC or AC type and shall be capable of varying the speed and power of a suitably sized electric motor by varying the voltage or average current delivered to a DC motor or by varying the frequency of power delivered to an AC motor. Power sources and DC or AC motors of these types are commercially available and well known in the art.

In some embodiments of the present invention, the reducing gear box 14 or another component within the curling broom such as the control element 12, is operable to control the speed of the electric motor 13 to keep it or another component within particular limitations. For instance, in some embodiments of the present invention, the rotary speed of the crank 18 may be limited to a set range of revolutions per minute and therefore the variable reciprocation frequency of the sinusoidal motion may be limited to a range of frequencies. In one particular example, the crank 18 may be limited to approximately six hundred revolutions per minute and the variable reciprocation frequency of the sinusoidal motion may be limited to approximately ten cycles per second (Hz). Other limits may be applicable depending on the tolerance of the user and the particular application. A sinusoidal motion of the brush head 5 is desirable for a reciprocating linear motion because it allows for smooth acceleration of the reciprocating components and results in minimum objectionable transmitted vibration to the ice surface, the other components of the broom, or to the user who is holding the handle of the broom.

Although shown as being coupled to a curling broom, it should be understood that the motor module 2 and the brush head 5 could be incorporated into other apparatus. For instance, in some embodiments, the motor module 2 and the brush head 5 could be adapted for attachment to a wheelchair or to another movable apparatus, motorized or manual. In the case of a wheelchair being adapted with an apparatus such as the motor module 2 and the brush head 5, it could allow wheelchair participants of curling to add sweeping to the game, thus making the sport more comparable in function and strategy to traditional curling.

Implementations of the present invention can allow individuals who can no longer sweep effectively to continue to participate as an effective team member in the game. The replacing of the back and forth manual sweeping action performed by a curler with a back and forth reciprocating action of the brush surface of the brush head while minimizing the forces required to be applied by the curler, can enable a wide variety of participants that may no longer be able to play the sport to rejoin and possibly enable some individuals with physical or mental disabilities to start participating.

Although various embodiments of the present invention have been described and illustrated, it will be apparent to those skilled in the art that numerous modifications and variations can be made without departing from the scope of the invention, which is defined in the appended claims.

What is claimed is:

1. A curling broom comprising:

an elongated handle;

a brush head, coupled to the elongated handle, comprising an ice interface element adapted for contact with ice on a curling rink; and a module comprising a motor and a crank coupled to the motor;

wherein the crank is operable to rotate when actuated by the motor and, when rotated, the crank is adapted to cause a sinusoidal reciprocating movement of the brush head; and wherein the crank comprises a counterbalance, thereby reducing vibration caused by the rotating of the crank.

2. A curling broom according to claim 1, wherein the brush head comprises a lateral slot with two parallel lateral surfaces adapted for the crank to be inserted, wherein the crank when rotated is adapted to push against the lateral surfaces of the lateral slot to cause the sinusoidal reciprocating movement of the brush head.

3. A curling broom according to claim 1, wherein the module further comprises a gear reduction element connected between the motor and the crank and adapted to limit a speed of rotation of the motor to a predetermined level.

4. A curling broom according to claim 3, wherein the gear reduction element limits the maximum reciprocating motion of the brush head to approximately ten hertz.

5. A curling broom according to claim 1, wherein the module further comprising a slide plate, the slide plate comprising at least one first slide element; and wherein the brush head comprises at least one second slide element that is adapted to slide in contact with the first slide element of the slide plate to allow lateral movement of the brush head relative to the slide plate.

6. A curling broom according to claim 5, wherein the crank when rotated is adapted to cause the second slide element of the brush head to slide through the first slide element of the slide plate, thereby causing lateral movement of the brush head.

7. A curling broom according to claim 6, wherein the brush head comprises a lateral slot with two parallel lateral surfaces adapted for the crank to be inserted, wherein the crank when rotated is adapted to push against the lateral surfaces of the lateral slot to cause the second slide element of the brush head to slide through the first slide element of the slide plate, thereby causing lateral movement of the brush head.

8. A curling broom according to claim 1 further comprising a control apparatus operable to dynamically control a speed of the motor.

9. A curling broom according to claim 8, wherein the control apparatus comprises a user control interface operable to modify the power to the motor dependent on a setting of the user control interface.

10. A curling broom according to claim 1, wherein the motor is incorporated within a module and the module is connected to the elongated handle and further connected to the brush head, whereby the brush head is coupled to the elongated handle via the module.

11. A curling broom according to claim 10, wherein the module is connected to the elongated handle via a flexible joint.

12. A curling broom according to claim 10, wherein the flexible joint comprises one of a gimbal and a yoke-and-trunnion.

13. A curling broom according to claim 10, wherein the brush head is removable from the module.

14. A curling broom according to claim 1, wherein the motor is an electric motor and the curling broom further comprises a power source to power the motor.

15. A curling broom according to claim 14, wherein the power source is integrated within the elongated handle.

16. A curling broom according to claim 14, wherein the elongated handle comprises first and second ends, the first end being coupled to the brush head; and wherein the power source comprises a battery pack integrated into the second end of the elongated handle.

17. A curling broom according to claim 16, wherein the battery pack is removable from the curling broom for charging.

18. A curling broom according to claim 16, wherein the battery pack is adapted with a charging terminal within the elongated handle.

19. A curling broom comprising:

an elongated handle;

a brush head, coupled to the elongated handle, comprising an ice interface element adapted for contact with ice on a curling rink;

a motor coupled to the brush head and operable to cause reciprocating lateral motion of the brush head; and a control apparatus operable to dynamically control a speed of the motor, wherein the control apparatus comprises a user control mechanism operable to modify the speed of the motor dependent on a physical position of an element of the mechanism.

20. A curling broom according to claim 19, wherein the user control mechanism is integrated within the elongated handle.

21. A curling broom according to claim 20, wherein the user control mechanism comprises a sliding handle operable to slide along a shaft of the elongated handle, wherein the speed of the motor is dependent upon the physical position of the sliding handle.

22. A curling broom according to claim 21, wherein, in a first position of the sliding handle, the speed of the motor is at a minimum level and, at a second position of the sliding handle, the speed of the motor is at a maximum level; wherein the user control mechanism further comprises a spring adapted to be compressed by a user moving the sliding handle from the first position towards the second position and adapted to decompress and move the sliding handle towards the first position if no force is applied to the sliding handle.

23. A curling broom according to claim 19, wherein the control apparatus further comprises a control element operable to control the speed of the motor based on a resistance setting of a potentiometer; wherein the user control mechanism comprises the potentiometer; and wherein the physical position of the element of the user control mechanism determines the resistance setting of the potentiometer.

24. A curling broom according to claim 23, wherein the control element comprises a power MOSFET coupled between a power source and the motor; wherein the control element is operable to activate and deactivate the power MOSFET based upon the resistance setting of the potentiometer, thereby controlling the speed of the motor.

25. An apparatus comprising:

a brush head comprising an ice interface element adapted for contact with ice on a curling rink and a brush head frame connected to the ice interface element;

a motor coupled to the brush head and operable to cause lateral reciprocating motion of the brush head; and a crank connected to the brush head frame and the motor; wherein the crank is operable to rotate when actuated by the motor and, when rotated, is adapted to cause a lateral reciprocating movement of the brush head.

26. An apparatus according to claim 25 further comprising an elongated handle coupled to the brush head.

27. An apparatus according to claim 25, wherein the motor is incorporated within a module, the module further comprising a slide plate, the slide plate comprising at least one first slide element; and wherein the brush head comprises at least one second slide element that is adapted to slide in contact with the first slide element of the slide plate to allow lateral movement of the brush head relative to the slide plate.

28. An apparatus according to claim 25, wherein the brush head frame is adapted to be connected to a slide plate, the slide plate comprising at least one first slide element; and wherein the brush head frame comprises at least one second slide element that is adapted to slide in contact with the first slide element of the slide plate to allow lateral movement of the brush head relative to the slide plate.

29. An apparatus according to claim 25, wherein the brush head frame comprises a lateral slot with two parallel lateral surfaces adapted for the crank to be inserted; whereby, when the crank is rotated, the crank is adapted to push against the lateral surfaces of the lateral slot to cause a sinusoidal reciprocating movement of the brush head.

30. A curling broom comprising:

an elongated handle;

a brush head, coupled to the elongated handle, comprising an ice interface element adapted for contact with ice on a curling rink;

a motor coupled to the brush head and operable to cause reciprocating lateral motion of the brush head; and a control apparatus operable to dynamically control a speed of the motor, wherein the control apparatus comprises a user control interface operable to modify the power to the motor dependent on a setting of the user control interface.

31. A curling broom comprising:

an elongated handle;

a brush head, coupled to the elongated handle, comprising an ice interface element adapted for contact with ice on a curling rink; and a motor coupled to the brush head and operable to cause reciprocating lateral motion of the brush head;

wherein the motor is incorporated within a module and the module is connected to the elongated handle and further connected to the brush head, whereby the brush head is coupled to the elongated handle via the module; wherein the module is connected to the elongated handle via a flexible joint comprising one of a gimbal and a yoke-and-trunnion.

32. A curling broom comprising:

an elongated handle;

a brush head, coupled to the elongated handle, comprising an ice interface element adapted for contact with ice on a curling rink; and a motor coupled to the brush head and operable to cause reciprocating lateral motion of the brush head;

wherein the motor is an electric motor and the curling broom further comprises a power source to power the motor and wherein the power source is integrated within the elongated handle.

33. A curling broom comprising:

an elongated handle;

a brush head, coupled to the elongated handle, comprising an ice interface element adapted for contact with ice on a curling rink; and a motor coupled to the brush head and operable to cause reciprocating lateral motion of the brush head;

wherein the motor is an electric motor and the curling broom further comprises a power source to power the motor; wherein the elongated handle comprises first and second ends, the first end being coupled to the brush head; and wherein the power source comprises a battery pack integrated into the second end of the elongated handle.

34. A broom comprising:

an elongated handle;

a brush head coupled to the elongated handle; and a module comprising a motor coupled to the brush head and a crank coupled to the motor that is operable to rotate when actuated by the motor, wherein the crank when rotated is adapted to cause a sinusoidal reciprocating movement of the brush head; and wherein the crank comprises a counterbalance, thereby reducing vibration caused by the rotating of the crank.

35. A broom comprising:

an elongated handle;

a brush head coupled to the elongated handle; and a module comprising a motor coupled to the brush head and a crank coupled to the motor that is operable to rotate when actuated by the motor, wherein the crank when rotated is adapted to cause a sinusoidal reciprocating movement of the brush head; and wherein the module further comprises a gear reduction element connected between the motor and the crank and adapted to limit a speed of rotation of the motor to a predetermined level.

* * * * *